US005595510A

United States Patent [19]

Obligar

[11] Patent Number: 5,595,510

[45] Date of Patent: Jan. 21, 1997

[54] SNAP-ON BATTERY CABLE CONNECTOR

[76] Inventor: Rizal A. Obligar, No. 19 Mystic Rose Dr., Sanville Subdivision Project 16, Quezon City, Philippines, 1100

[21] Appl. No.: 554,360

[22] Filed: Nov. 6, 1995

[30] Foreign Application Priority Data

Aug. 31, 1995 [PH] Philippines ..... 14001

[51] Int. Cl.[6] ..... H01R 4/28

[52] U.S. Cl. ..... 439/761; 439/801; 439/773; 439/764

[58] Field of Search ..... 439/761, 773, 439/772, 757, 771, 20, 801, 883, 764, 763

[56] References Cited

U.S. PATENT DOCUMENTS

| | | | |
|---|---|---|---|
| 1,727,219 | 9/1929 | Scharf et al. . | |
| 1,841,371 | 1/1932 | Hughes . | |
| 1,957,131 | 5/1934 | Brown | 439/801 X |
| 2,039,669 | 5/1936 | Tenney . | |
| 2,125,203 | 7/1938 | Schanbacher . | |
| 3,521,223 | 4/1968 | Martinez | 439/761 X |
| 3,636,504 | 1/1972 | Applegate . | |
| 3,739,322 | 6/1973 | Haegert . | |
| 3,893,744 | 7/1975 | Porazinski . | |
| 3,963,303 | 6/1976 | Hays . | |
| 4,029,383 | 6/1977 | Harding et al. . | |
| 4,367,008 | 1/1983 | Piriz . | |
| 4,380,291 | 4/1983 | Shannon . | |
| 4,555,159 | 11/1985 | Chartrain et al. | 439/773 OR |
| 4,636,025 | 1/1987 | Norris | 439/764 X |
| 5,024,621 | 6/1991 | Mata . | |
| 5,254,020 | 10/1993 | Obligar . | |

*Primary Examiner*—Gary F. Paumen
*Assistant Examiner*—Daniel Wittels
*Attorney, Agent, or Firm*—Fulwider Patton Lee & Utecht, LLP

[57] ABSTRACT

A snap-on battery cable connector including an electrically conductive, elongated body formed with a pair of semi-circular jaws projecting from a central yoke and cooperating to form a battery terminal-receiving socket and formed distally with respective ears formed with first and second bores. An eccentric cam is received rotatably in the first bore and a connector pin in the second bore. A connector link connects between the pin and cam to cooperate with a crank handle mounted on cam to selectively draw the ears together to grip the terminal. A cable connector ring is carried from the yoke and is formed with a connector bore which receives a stud held therein by a cross pin and projecting therefrom to form an upstanding threaded shaft and further including a fastener for fastening the stud to the connector and a connector nut for receipt on such shaft.

4 Claims, 2 Drawing Sheets

SNAP-ON BATTERY CABLE CONNECTOR

BACKGROUND OF THE INVENTION

1. Field of the Invention

The present invention relates to an improved snap-on battery cable connector.

2. Description of the Prior Art

Battery cable connectors are typically formed with semi-circular jaws having free extremities joined together by a cross bolt which is then adjusted by manipulation of the bolt head by wrenches, pliers and the like. Such devices typically incorporate a battery cable clamp having a collar connected to the body of the connecter by means of threaded studs to then be clamped about the conductive strands of the battery cable. A device of this type is shown in U.S. Pat. No. 3,893,744. Such devices suffer the shortcoming that, in addition to requiring pliers, wrenches or the like to tighten the connector on the battery terminal, certain obstacles are often encountered when it is necessary to remove the collar from a battery cable for replacement or repair. Often times the studs holding the cable collar in position become corroded or deteriorated as a result of the generally corrosive atmosphere and sometimes the direct application of battery acid and the like thereto.

The cable connector shown in my U.S. Pat. No. 5,254,020 incorporates a cam linkage for manipulating the battery terminal gripping jaws to thus eliminate the necessity of adjustment tools for adjusting the jaws themselves. However, that connector continues to suffer the shortcoming of incorporating a collar which clamps to the strands of the cable by means of a pair of screws which are subject to deterioration and corrosion over time.

Other efforts to provide a satisfactory cable connector have led to the proposal of shrink tubing or the like for gripping a neck formed in the cable connector to thereby form a secure connection with the battery cable itself. A device of this type is shown in Hayes U.S. Pat. No. 3,963,303. Such devices suffer the shortcoming that different diameters of connector tubing is required for connection of different diameter battery cables and the removal of such connectors from the battery cable presents certain challenges and often results in destruction of the tubing and/or damage to the cable itself.

Connectors have also been proposed with malleable barrels configured with an open end for receipt of the battery cable so that the barrels may be crimped down on the battery cable. A device of this type is shown in Piriz U.S. Pat. No. 4,367,008. Such devices likewise suffer the shortcoming that, in order to remove the connectors, the barrels themselves must often be severed or otherwise deformed often resulting in damage to the battery cable.

Thus, there exists a need for a battery connector which is easily installed and which can be conveniently connected to, and disconnected from, the battery cable.

SUMMARY OF THE INVENTION

The improved snap-on battery cable of the present invention is characterized by integral semi-circular jaws radiating outwardly from a central yoke and formed on their free extremities with respective bores which receive, respectively, a connector pin and an eccentric cam connected together by a connector link. A lever handle is provided for rotating the cam. Connected to the yoke is an electrically conductive cable connector ring configured with a connector bore which receives one end of a connector stud which is formed with an upstanding threaded shaft for receipt thereof in the bore of an electrically conductive battery cable connector clip.

Other objects and features of the invention will become apparent from consideration of the following description taken in conjunction with the accompanying drawings.

DESCRIPTION OF THE PREFERRED EMBODIMENT

Figure 1:
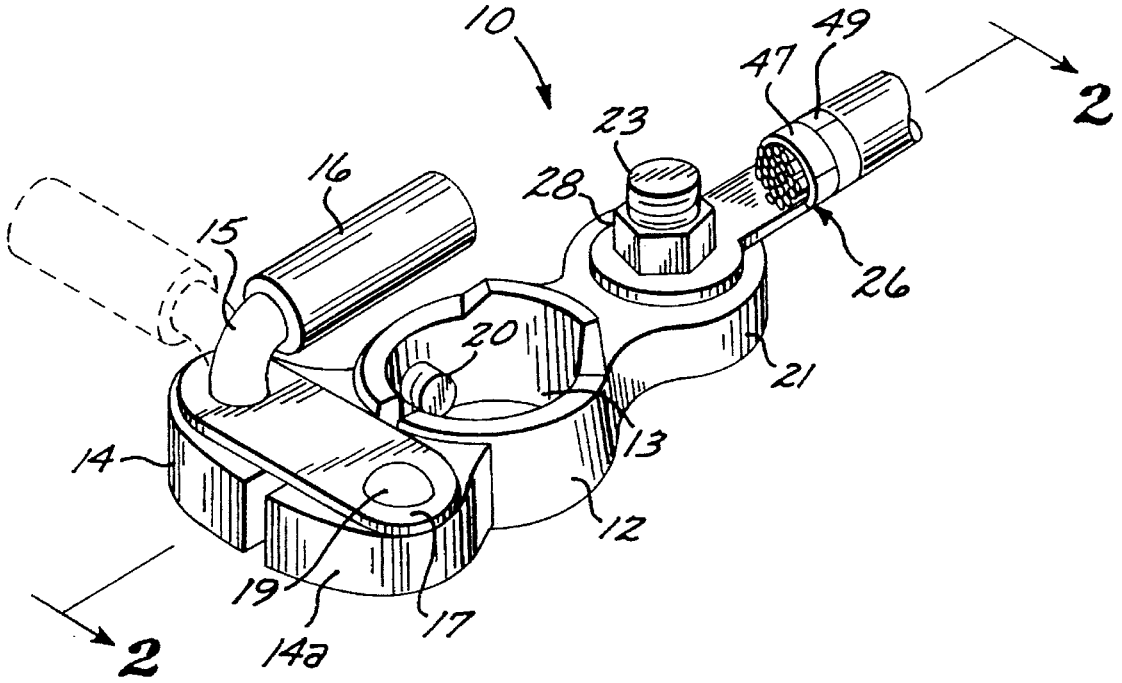
FIG. 1 is a perspective view of an improved snap-on battery cable connector embodying the present invention.
Figure 3:
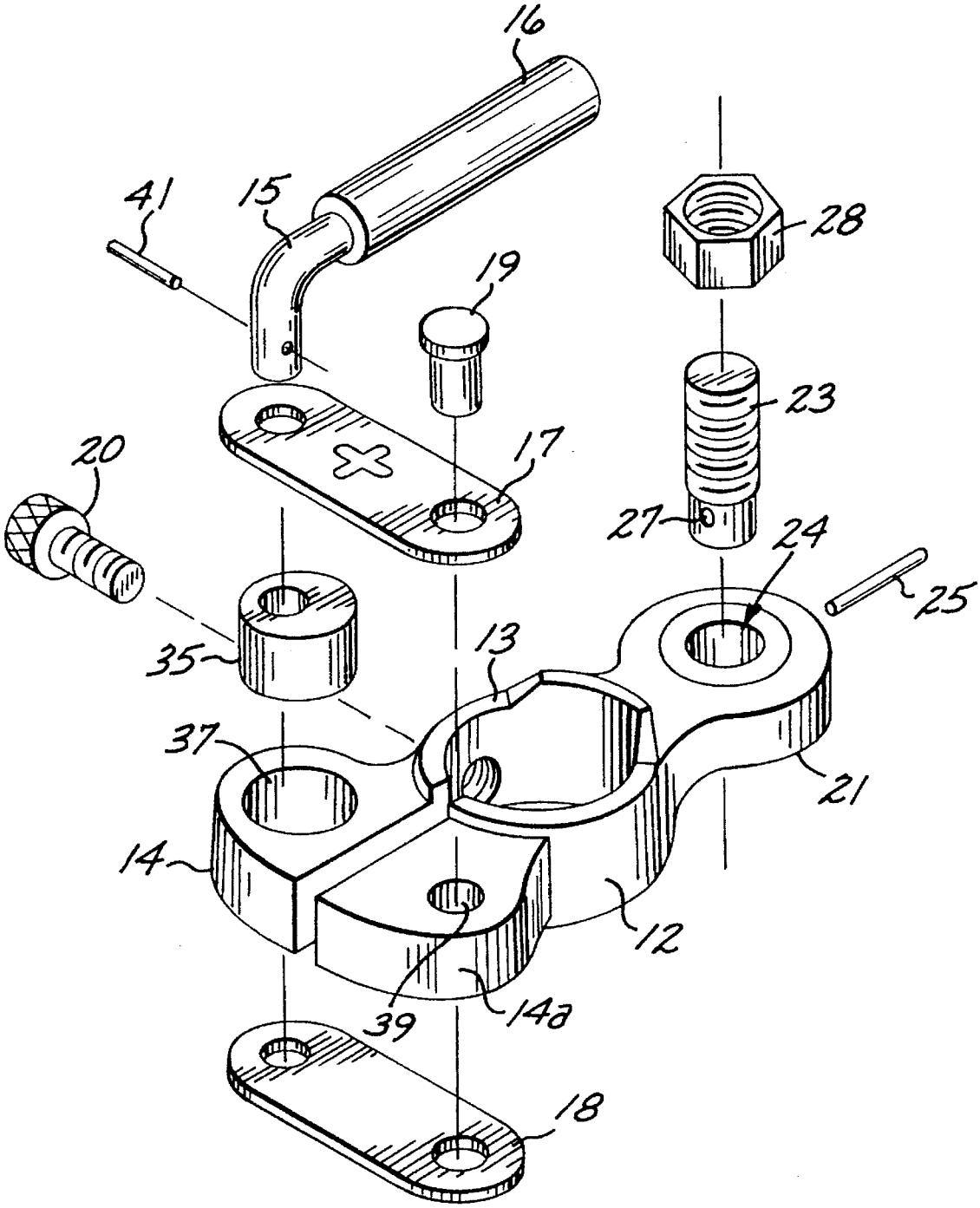
FIG. 3 is an exploded perspective view similar to FIG. 1.

Referring to FIGS. 1 and 3, the battery cable connector of the present invention is in the form of a flexible yoke having semi-circular flexible jaws 12 and 13 projecting therefrom and configured on their respective free ends with respective ears 14 and 14*a* which are coupled together by a pair of connector links 17 and 18 connected between a connector pin 19 and eccentric cam 35. Formed integral with the yoke is a battery cable connector ring 21 configured centrally with a through bore 24 for receipt of a threaded stud 23. The stud 23 projects through a battery cable clip 26 and is secured thereto by means of a fastener nut 28.

In practice, it is desirable to provide a cable connector which is of sturdy construction, practical in use and can be operated with a minimum number of tools and can be readily connected and disconnected from a battery cable. To that end, I provide my cable connector with an integral, electrically conductive flexible body which may be constructed of brass or other electrically conductive material. The connector is constructed with a central body portion in the form of a pair of the semi-circular jaws 12 and 13 which radiate outwardly from a central waist defining a yoke and are configured on their respective free ends with the generally bubble-shaped, horizontally disposed flat ears 14 and 14*a* configured with respective longitudinally extending confronting vertical edges spaced apart a selected distance to provide sufficient freedom of movement so that the ears and, consequently the jaws 12 and 13, may be flexed on their free extremities toward and away from one another. Referring to FIG. 3, the ear 14 is formed with a large diameter bore 37 for free rotational receipt of the cylindrical eccentric cam 35. The ear 14*a* is formed with a small diameter bore 39 for receipt of the shaft of the connector pin 19. The leg 13 is formed with a threaded diametrical bore for threaded receipt of the shaft of a thumb screw 20.

The connector links 17 and 18 are disposed in sandwiching configuration on the respective oppositely disposed sides of the respective ears 14 and 14*a* and are formed at their opposite ends with respective bores for rotatable receipt of the respective handle 16 and connector pin 19. The lever handle 16 is L-shaped to be formed with a vertical bearing leg 15 penetrating through respective bores in the respective ends of the links 17 and 18 and is configured with a transverse bore for receipt therein of a locked pin 41 which extends through a complementary diametrical bore in the cam 35.

The battery connector ring 21 is conveniently configured integral with the jaws 12 and 13 and is formed with a concentric upstanding annular stand-off shoulder. Such ring is further formed with a diametrical bore 43 (FIG. 2) aligned with a corresponding bore 45 formed in the stud 23 for interference of a fastener pin 25. The stud 23 is formed on its lower extremity with a shank and is fit on its upper extremity with an upstanding threaded shaft for threaded receipt of a fastener nut 28.

A battery connector clip, generally designated 26, is conveniently configured with a flat plate having a reduced in cross section neck and formed on its free extremity with a flat washer configuration and on its connector end with a pair of malleable bands 47 and 49 configured to embrace the strands of the battery cable.

Figure 2:
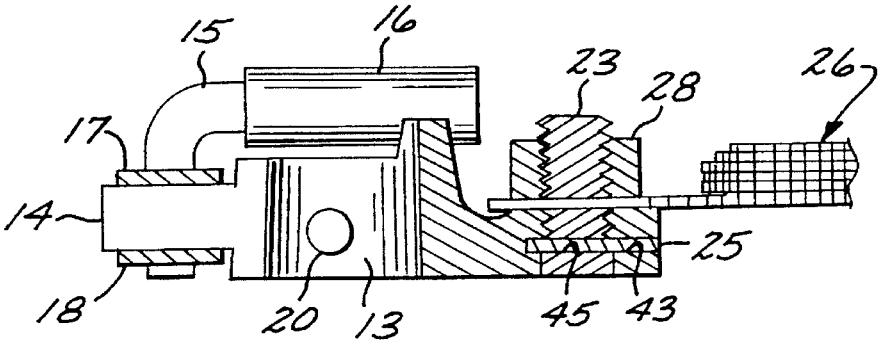
FIG. 2 is a longitudinal sectional view, in reduced scale, taken along the line 2—2 of FIG. 1.

In operation, it will be appreciated that for installation the clip 26 will be secured to the free end of the battery cable by wrapping the bands 47 and 49 about the cable strands for gripping engagement therewith to form a secure electro connection. The washer shaped free end of the clip 26 may then be fitted over the upstanding threaded shaft 23 and the nut 28 screwed thereonto and tightened in position for making a positive electrical connection. Such nut may be tightened securely by use of a single wrench. It will be understood that the stud 23 is secured against rotation in its receiving bore 24 by means of the fastener pin 25 (FIG. 2).

When the battery is installed and it is desirable to secure the connector pin thereto, the lever handle 16 may be rotated to the broken line position shown in FIG. 1 to cause the cam 35 to drive the ears 14 and **14*a* apart thus driving the free extremities of the jaws 12 and 13 apart to open the circular socket formed therebetween for sliding receipt over the top of the battery terminal. The connector may then be fitted down over the battery terminal and the handle 16 rotated to its outline position shown in FIG. 1 thereby drawing the free extremities of the jaws together to firmly grip the opposite sides of the terminal. If desired, the thumbs 20** may then be tightened to make a high pressure contact with the battery terminal for secure and positive electrical connection.

From the foregoing it will be clear to those skilled in the art that the battery connector of the present invention provides an economical and secure arrangement for conveniently connecting the free ends of battery cables to battery terminals. The device is constructed so that the initial connection may be easily and conveniently made and, in the event of a subsequent desire to disconnect, the connection nut 28 may be easily unscrewed and the conductor 26 disconnected.

What is claimed is:

1. An improved snap-on battery cable connector comprising:

an elongated electrically conductive body including a pair of semi-circular jaws projecting from a flexible central yoke and cooperating to form a circular battery terminal receiving socket having a central axis, said jaws formed with respective free ends configured with respective ears, formed with respective first and second bores having respective axes projecting parallel to said central axis;

an eccentric cam rotatably received in said first bore;

a connector pin received in said second bore;

a connector link connected between said cam and said pin;

a handle mounted on said cam for rotation thereof to draw the respective said ears together and flex said jaws inwardly toward one another;

a cable connector ring carried from said yoke and formed with a connector bore;

a connector stud received on one end in said connector bore and projecting therefrom to form an upstanding threaded shaft;

a fastener for fastening said stud to said connector; and a connector nut for receipt of said threaded shaft.

2. An improved snap-on battery cable connector according to claim 1 wherein:

said connector ring is formed with a transverse fastener bore;

said stud is formed with a shank configured with a transverse fastener bore registered with said first mentioned fastener bore and wherein said connector includes;

a fastener pin received in said fastener bore.

3. An improved snap-on battery cable connector according to claim 1 that includes:

a battery clip for securement to a battery cable and formed with a washer element formed with a bore for telescopical receipt on said stud.

4. An improved snap-on battery cable connector according to claim 3 wherein:

said clip includes at least one malleable band for bending into gripping configuration to grip a battery cable.

* * * * *